US010663135B2

(12) United States Patent
Garin et al.

(10) Patent No.: US 10,663,135 B2
(45) Date of Patent: May 26, 2020

(54) LIGHT MODULE FOR A VEHICLE HEADLIGHT

(71) Applicant: VALEO VISION, Bobigny (FR)

(72) Inventors: Pascal Garin, Bobigny (FR); Stephane Andre, Bobigny (FR); Remi Letoumelin, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/193,279

(22) Filed: Nov. 16, 2018

(65) Prior Publication Data

US 2019/0154224 A1 May 23, 2019

(30) Foreign Application Priority Data

Nov. 20, 2017 (FR) ..... 17 60928

(51) Int. Cl.

| | |
|---|---|
| ***F21V 1/00*** | (2006.01) |
| ***F21S 41/29*** | (2018.01) |
| ***F21S 41/20*** | (2018.01) |
| ***F21S 41/153*** | (2018.01) |
| *F21S 41/265* | (2018.01) |
| *F21S 41/143* | (2018.01) |

(52) U.S. Cl.
CPC ..... *F21S 41/29* (2018.01); *F21S 41/153* (2018.01); *F21S 41/285* (2018.01); *F21S 41/143* (2018.01); *F21S 41/265* (2018.01)

(58) Field of Classification Search
CPC ..... F21S 41/29; F21S 41/153; F21S 41/285; F21S 41/265; F21S 41/143; B60Q 1/00
See application file for complete search history.

(56) References Cited

U.S. PATENT DOCUMENTS

| | | | | |
|---|---|---|---|---|
| 9,534,755 | B2 * | 1/2017 | Blandin | F21S 41/192 |
| 2010/0073950 | A1 | 3/2010 | Kawamura | |
| 2014/0226355 | A1 | 8/2014 | Blandin et al. | |
| 2015/0285455 | A1 * | 10/2015 | Sudahl | F21S 41/29 362/520 |
| 2016/0102831 | A1 | 4/2016 | Okubo et al. | |

FOREIGN PATENT DOCUMENTS

| | | | |
|---|---|---|---|
| EP | 2 998 647 | A1 | 3/2016 |
| EP | 3 104 061 | A1 | 12/2016 |
| JP | 2012-119260 | | 6/2012 |
| WO | WO 2013/037799 | A1 | 3/2013 |

OTHER PUBLICATIONS

French Preliminary Search Report dated Apr. 25, 2018 in French Application 17 60928, filed on Nov. 20, 2017 (with English Translation of Categories of Cited Documents).

* cited by examiner

*Primary Examiner* — Ali Alavi
(74) *Attorney, Agent, or Firm* — Oblon, McClelland, Maier & Neustadt, L.L.P.

(57) ABSTRACT

A light module for a motor vehicle headlight, including at least two light sources, two optical elements, respectively configured for guiding light rays emitted by a light source, and an attachment support, against which the optical elements and the light sources are disposed. The optical elements include at least one first optical element associated with a first light source and one second optical element associated with a second light source. The light module includes a frame for retaining the optical elements on the attachment support.

20 Claims, 3 Drawing Sheets

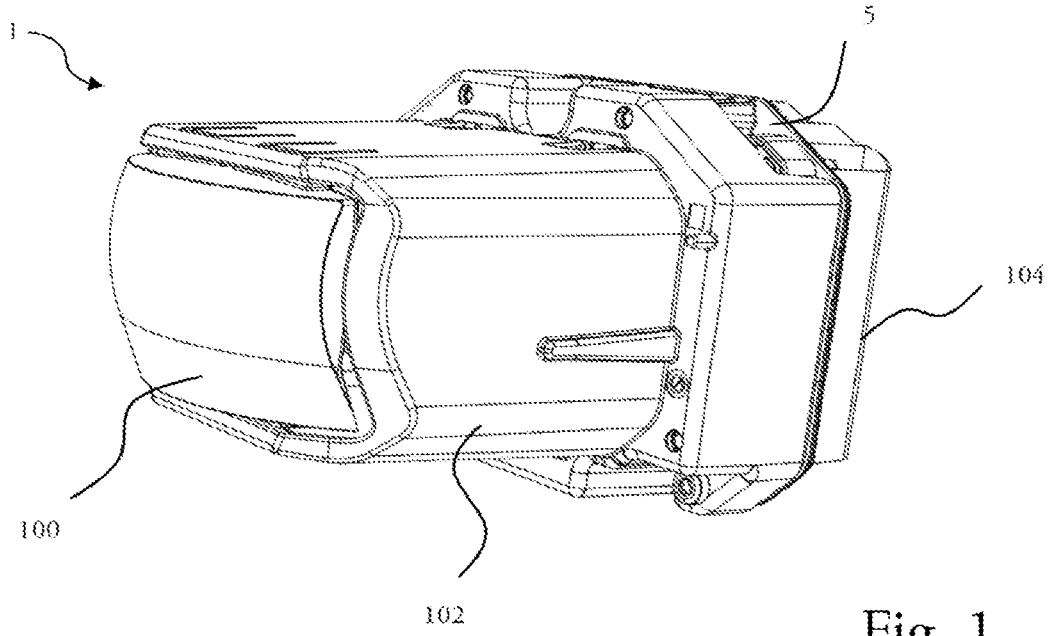
Fig. 1
Fig. 2
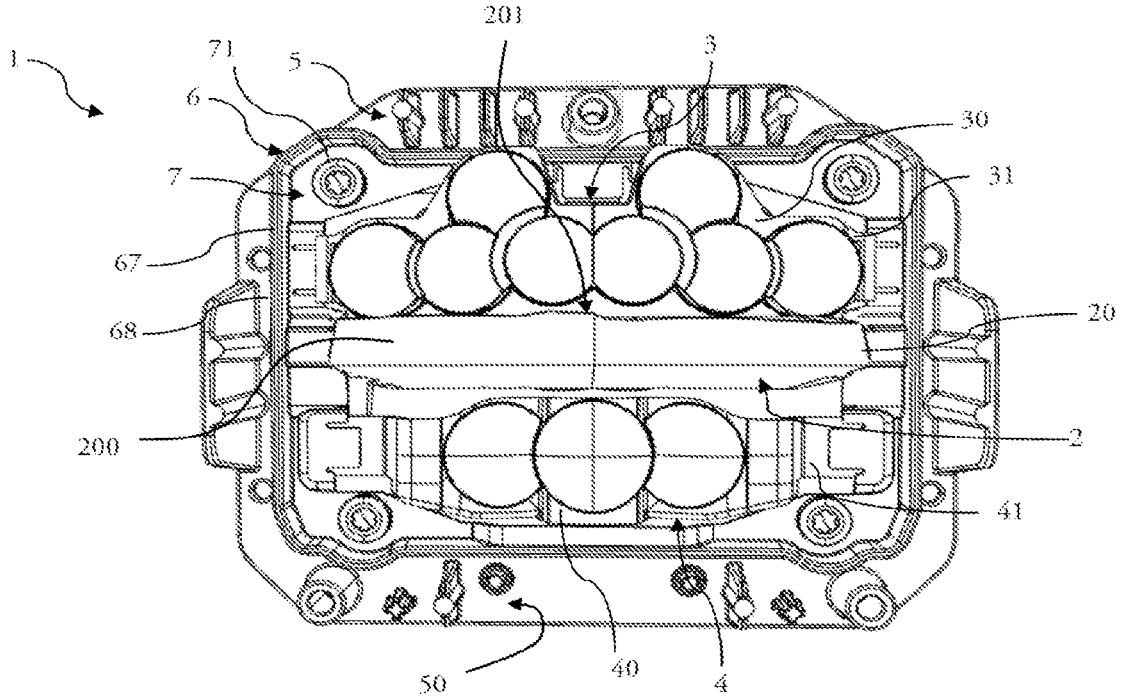

LIGHT MODULE FOR A VEHICLE HEADLIGHT

The invention relates to the field of lighting and/or signaling devices for motor vehicles. More specifically, it relates to the light modules that are intended to be mounted in a headlight for a vehicle.

Motor vehicle headlights are normally formed by a housing, which is closed by a transparent wall, through which light rays pass. This housing houses at least one light module, mainly comprising at least one light source and one optical system capable of modifying at least one parameter of the light generated by the light source in order to emit light rays that are then able to pass through the transparent wall of the headlight in order to form regulatory light beams.

The advancement of techniques tends to favour the use of light sources formed by at least one Light Emitting Diode (LED) due to their low energy consumption, their low spatial requirement and the quality of the lighting that is obtained.

An optical system equipping a light module can comprise optical elements configured to orient the light rays towards a ray-shaping lens for the projection, out of the module and the headlight, of a regulatory light beam. The light sources and the corresponding optical elements particularly can be configured to generate a first light beam, called high beam, and a second light beam, called low beam. According to a known configuration, light sources, for example, light emitting diodes, are attached on a base also forming a support for the optical elements, so that their mutual positioning is reliable.

In this known configuration, the optical elements of the light module are assembled independently of one another on the base of the light module forming an attachment support. To this end, each of the optical elements can comprise openings formed in the thickness of the material, advantageously in end zones of these optical elements, so as not to undermine the guidance of the light rays therein, and the optical elements are assembled on the attachment support so that these openings are placed facing bores formed on the attachment support to allow screw fixing of the optical element on the attachment support.

Various disadvantages arise from such a configuration and from the resulting assembly method. With respect to the assembly method in itself, the requirement for independently screw fixing each of the optical elements on the attachment support takes a considerable amount of assembly time. Furthermore, with respect to the design of the optical elements needed to equip such a module, machining operations need to be provided in order to form each of the openings of the optical elements and a specific location needs to be provided, which is not detrimental to the optical function, and a specific thickness needs to be provided for the zone in which the opening has to be made, such that designing these optical elements equally entails an optical challenge, in order to provide proper guidance of the light rays, and a mechanical challenge, to ensure that the attachment on the support will be suitable. Another disadvantage of this solution arises from the fact that the optical elements are mechanically stressed by screwing. The effect of this mechanical stress can be to deform the optical elements and thus can affect the orientation of the light beams output from the module.

The aim of the present invention is to overcome at least one of the aforementioned disadvantages and to propose a light module that allows its manufacturing and assembly cost to be reduced, whilst avoiding mechanically stressing the optical elements of such a light module.

To this end, the aim of the invention is a light module for a motor vehicle headlight, comprising at least two light sources, two optical elements, respectively configured for guiding light rays emitted by a light source, and an attachment support, against which the optical elements and the light sources are disposed, the optical elements comprising at least one first optical element associated with a first light source and one second optical element associated with a second light source, characterized in that the light module comprises a frame for retaining the optical elements on the attachment support.

By virtue of this retention frame, it is possible for the optical elements to no longer be mechanically stressed. Indeed, the optical elements are no longer screw fixed on the attachment support. In other words, the retention frame is used to keep the optical elements pressed against the attachment support, so that no mechanical screwing stress is exerted directly onto the optical elements.

Furthermore, the retention frame reduces the number of all the openings and bores that are respectively formed on the optical elements and on the attachment support. It will be understood that this results in a reduction in the costs for machining and assembling such a light module. Indeed, during assembly steps, only the retention frame is attached to the attachment support. Through the assembly steps, it is envisaged, for example, for each of the optical elements to be positioned in a first instance, before the retention frame is positioned in a second instance, so as to keep each of the optical elements in abutment against the attachment support and to attach the retention frame on the attachment support.

It is worthwhile noting that the advantage of retaining the optical elements using the retention frame is to eliminate the mechanical screwing stresses on these optical elements. The mechanical screwing stresses of the optical elements are then transferred to the retention frame, which is designed to withstand mechanical stresses, with the optical elements henceforth being designed only with respect to optical stresses, which allows the optical performance of these elements to be improved.

Each of the optical elements can have a central optical portion, forming an optical guidance means, and lateral tabs, transversely arranged on either side of the central optical portion.

The retention frame is configured to at least partly cover the tabs of each of the optical elements, i.e. the lateral ends of each of the optical elements. Such coverage advantageously allows an even force to be exerted on the ends of the optical elements. It will be understood that the ends of the optical elements are clamped, or trapped, between the retention frame and the attachment support.

According to one feature of the invention, the tabs of each optical element can be arranged in order to be at least partly correspondingly housed in slots formed in the retention frame. Thus, it is possible to keep each of the optical elements between the retention frame and the attachment support in the desired optical position. Indeed, matching the tabs of the optical elements with the slots of the retention frame ensures that the retention frame, when it is added to cover the lateral ends, or tabs, of the optical elements, has a stable position against the attachment support. It will be understood that when the retention frame is assembled on the attachment support, the optical elements are locked in their optical position.

A tab of an optical element can be housed in an associated slot, particularly since the thickness of the relevant tab is the same size as the depth of the relevant slot.

The tabs of each optical element can be formed by a first portion, arranged in the direct extension of the corresponding lateral end of the optical guidance part, and by a second portion intended to be clamped between the retention frame and the attachment support. The tabs of the optical elements then allow the optical guidance means to be raised relative to a plane in which the attachment support extends.

It is envisaged that the tabs of each optical element will each support indexing fingers configured for engaging with openings formed in the attachment support. By virtue of this feature, each optical element can be positioned on the attachment support before the retention frame is added in order to set the position of the optical elements. This thus ensures that each optical element is correctly positioned relative to the attachment support. By virtue of this configuration for each optical element, at least one corresponding light source can be aligned with the optical guidance means in order to ensure the correct orientation of the resulting light beam.

More specifically, the indexing pins can be formed on the second portions of the tabs.

According to a variation, fingers formed in slots of the retention frame come into abutment against the tabs of at least one optical element. More specifically, at least one positioning finger is formed in the retention frame, in the zone of a slot of the retention frame, with said positioning finger being configured to come into abutment against a tab of at least one optical element.

The positioning finger can comprise a resilient base formed in the plane of the retention frame and delimited by two cuts in the zone of the slot, and a pad forming a projection from the base in order to come into abutment on the tab. By virtue of these fingers, a pressure can be maintained on the tabs of the optical elements without applying mechanical pressure thereto.

In order to allow the fingers formed in the slots of the retention frame to be flexed, each base can be delimited by two cuts produced in the corresponding slot. The elasticity of the base then allows the pad to always be in contact with the corresponding tab, irrespective of the variations in clearance between the tab and the housing from one module to the next.

According to one contemplated embodiment, at least the first optical element is made of poly(methyl methacrylate) (PMMA). It will be understood that the same can be the case for the second and third optical elements.

In order to ensure that the retention frame is attached on the attachment support, provision is made for the retention frame to comprise at least one means for attaching on the attachment support of the light module. It will be understood that the retention frame allows the mechanical screwing stresses to be transferred from the optical elements, with the retention frame being screw fixed on the attachment support and the retention elements only being retained by pressing the retention frame against the attachment support. It will be understood that this means for attaching the retention frame is, advantageously, disposed in zones that are remote from the slots, so that the tabs of the optical elements matching these slots do not experience any mechanical screwing stress. Of course, in order to fixedly hold the retention frame against the attachment support, a plurality of attachment means can be provided.

The attachment means can be, for example, formed by a hole in the retention frame facing a bore in the attachment support of the light module, with the hole of the retention frame and the corresponding bore of the attachment support being configured to receive a fixing screw.

Further features of the retention frame can be contemplated separately or in combination with one another. In this case, provision can be made for:

- the retention frame to be formed by four branches, for which two first branches facing each other comprise the slots;
- two second branches of the retention frame facing each other to comprise the one or more attachment mean(s);
- the first branches to retain the optical elements, whereas the second branches ensure that the retention frame is attached on the attachment support, with this configuration allowing a distinction to be made between the function of the retention frame that is intended to retain the optical elements and the function of the retention frame that is intended to attach the retention frame on the attachment support;
- at least one of the second branches to comprise a slot for receiving a tab of an optical element;
- the slots produced on the frame and that are associated with the same optical element to be identical to each other;
- the retention frame to comprise at least one stiffening rib intended to enhance its mechanical strength;
- the stiffening rib to define the profile of the retention frame;
- the retention frame to be made of a plastic material different from the optical element;
- the retention frame to be of rectangular shape;
- the retention frame to be produced as one piece.

Advantageously, the attachment support is a support for thermally dissipating calories released by the light sources.

The light module can comprise more than two optical elements, and, in particular, a third optical element can be associated with a third light source, with it being understood that, according to the invention, the retention frame is configured to keep each of the optical elements in position by clamping them with the attachment support against which the retention frame is attached.

In the case of three optical elements, provision can be made for the first optical element to be disposed between the second optical element and the third optical element, in a light module that is configured to complete both a function for projecting a beam, called low beam, and a function for projecting a beam, called high beam. The first optical element can be configured to participate in the formation of a beam complementary to the beam formed by the second optical element, with this beam formed by the second optical element consisting in a beam that is called low beam. It should be noted that an edge of the central optical portion of the first optical element can form a cut-off edge for the beam formed by the second optical element and its associated light source. The addition of the beam formed by the second optical element and of the additional beam results in the formation of an overall beam of the high beam type. The third optical element can be configured to allow an additional beam to be formed for over-intensifying the overall beam formed by the complementarity of said beam and said additional beam.

According to one feature of the invention, the light module comprises a shaping lens arranged at the output of this light module, with the shaping lens being arranged to shape at least part of the light beams in order to:

project at least the light rays exiting the second optical element into a light beam, called low beam, i.e. comprising a cut-off zone; and project at least the same rays and the light rays exiting the first optical element into an overall light beam, called high beam.

In this context, provision particularly can be made for:

the optical elements to be distinguished from one another so that the first optical element can comprise a first means for converging at least the first light beam, the second optical element can comprise a second means for converging at least the second light beam and the third optical element can comprise a third means for converging at least the third light beam;

the central optical portion of the first optical element, arranged between the two other optical elements, exhibits an elongated shape along the optical axis of the light module, so as to extend beyond the second and third optical elements, opposite the attachment support of the light module.

According to another aspect, the aim of the invention is a motor vehicle headlight comprising at least one light module as previously described.

Further features, details and advantages of the invention will become more clearly apparent upon reading the following description, which is provided by way of an example, with reference to the accompanying drawings, in which:

FIG. 1 is an overall view of a light module according to one embodiment of the invention, showing an attachment support, on one side of which a thermal dissipation component is added and on the other side of which a casing is added covering optical elements, not shown herein, and allowing the attachment of a shaping lens;

FIG. 2 is a top view of the light module of FIG. 1, in which the housing and the ray-shaping lens have been removed in order to reveal the attachment support, the optical elements and a frame for retaining these optical elements against the attachment support;

Figure 3:
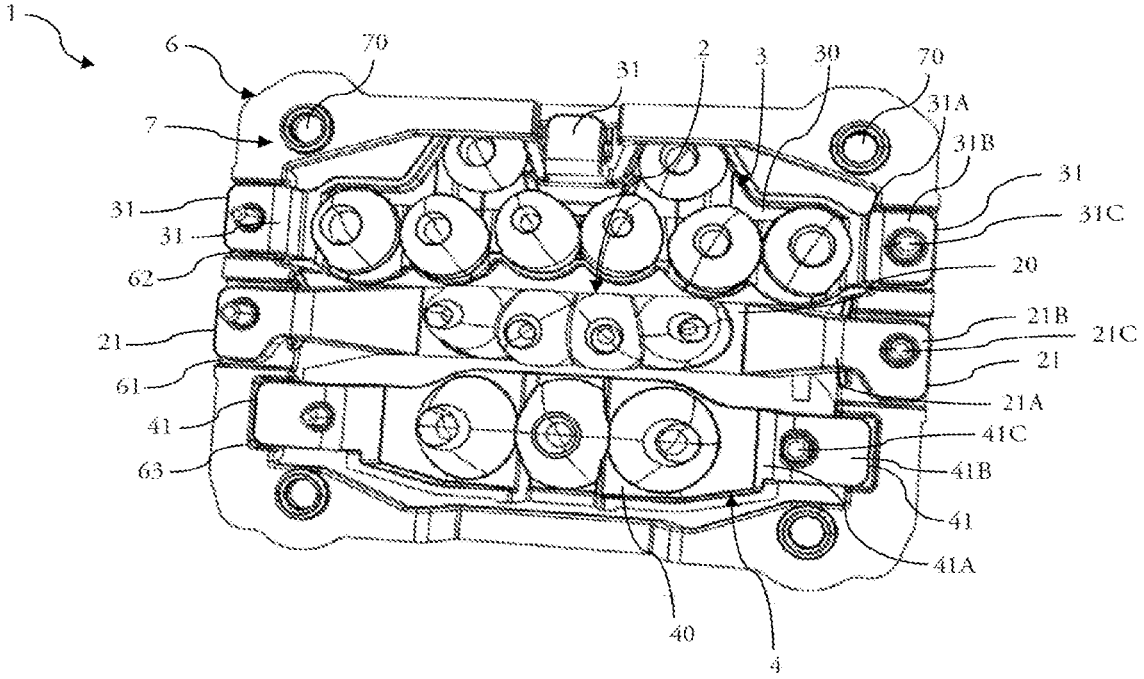
FIG. 3 is a bottom view of the optical elements and of the retention frame of FIG. 2, with the attachment support having been removed in this case.

FIG. 1 shows a light module 1 according to the invention, also called optical module, the purpose of which is to generate one or more light beams and to project them on a road. Such a light module 1 is intended to be installed in a headlight of a motor vehicle, which is not shown in the figures in order to better understand the invention. It will be noted that the headlight discussed herein generally comprises a rear housing that is closed at the front by a transparent outer lens, said outer lens being traversed by the light rays generated by the light module according to the invention. Such a headlight thus can receive, in its internal volume that is delimited by the rear housing and the transparent outer lens, a plurality of light modules, and at least one light module according to the invention.

Such a light module 1 forms a single sub-assembly, i.e. an object that can complete its purpose without any contribution other than the electrical energy needed for the illumination thereof.

The light module 1 according to the invention is arranged to generate a low beam and a high beam, one after the other or both at the same time. As will be explained in further detail hereafter, the light module 1 is adapted so that the high beam involves the combination of the low beam with an additional beam.

The light module 1 comprises at least a plurality of light sources and a plurality of associated optical elements. It also comprises at least one lens 100 arranged at one end of the module in order to be traversed by the light rays emitted by the light sources and guided by the optical elements. Such a shaping lens 100 helps to form the desired light beam, whether it is a beam of the low beam type or a beam of the high beam type. In other words, the shaping lens 100 forms a first longitudinal end of the light module 1.

FIG. 1 also shows the presence of a casing 102 that is of substantially tubular shape and extends between a base forming an attachment support 5 and the shaping lens, with such a housing particularly providing the mechanical support for the shaping lens, as well as a mechanical reference for the position of the lens relative to the light sources and to the optical elements, so as to ensure a determined position for the shaping lens relative to the light sources.

The attachment support 5 can have, on the face thereof that is opposite the housing 102, a thermal dissipation component 104, which is intended to discharge at least part of the heat from the light module 1 that is generated by the light sources.

FIG. 2 shows part of the light module 1, and particularly the attachment support 5 without the housing 102, so as to better understand the arrangement in the light module 1 of the optical elements that are associated with the light sources, not shown. According to the invention, these optical elements are attached on the attachment support by means of a retention frame 6, without requiring the provision of specific attachment means for each optical element. In the following example, a light module will be described that is equipped with three optical elements respectively facing a light source, and the retention frame will be described as being configured to allow coverage and attachment of these three optical elements, but it will be understood that a retention frame will be a frame according to the invention if it allows a different number of optical elements to be pressed against, and thus held in position, the attachment support, as long as there are at least two elements.

In the example more specifically shown in FIGS. 2 and 3, the light module 1 comprises a first optical element 2 configured to provide guidance for light rays emitted by a first light source, not shown, a second optical element 3 configured to provide guidance for light rays emitted by a second light source, not shown, and a third optical element 4 configured to provide guidance for light rays emitted by a third light source, not shown.

In the aforementioned description, a light source is understood to be one or more light sources forming a sub-assembly that is controlled in order to emit light rays configured to complete an optical function. More specifically, a first light source, or a first sub-assembly of light sources, is associated with the first optical element 2 in order to generate a first light beam, and a second light source, or a second sub-assembly of light sources, is associated with the second optical element 3 in order to generate a second light beam. This second light beam corresponds to a beam of the low beam type, having a cut-off edge, which in this case is formed by the edge 200 of the free end face 201 of the first optical element 2, which is located on the side of the second optical element. The first light beam, exiting this free end face of the first optical element, thus has a beam shape complementary to the second light beam, such that the simultaneous emission of rays by the first and the second source helps to form an overall beam of the high beam type.

Furthermore, a third light source, or third sub-assembly of light sources, is associated with the third optical element 4 to generate light rays capable of over-intensifying the centre of the overall beam of the high beam type.

Each of the optical elements has a general shape having a central optical portion, forming an optical guidance portion, and lateral tabs, transversely arranged on either side of the central optical portion.

More specifically, and as is particularly shown in FIG. 3, the first optical element 2 comprises a first optical guidance means 20 extended at its lateral ends by first tabs 21, the second optical element 3 comprises a second optical guidance means 30 extended at its lateral ends by second tabs 31 and the third optical element 4 comprises a third optical guidance means 40 extended at its ends by third tabs 41.

These optical elements 2, 3, 4 are provided in order to be disposed on an attachment support 5, and, more specifically, on a first face 50 of the attachment support. In the configuration of this illustrated embodiment, the first optical element 2 is disposed on the attachment support 5 between the second and third optical elements 3, 4.

As previously stated, according to the invention provision is made for the light module to comprise a frame 6 for retaining the optical elements 2, 3, 4 against the attachment support 5. The purpose of such a retention frame 6 is to keep the optical elements 2, 3, 4 against the attachment support 5 without exerting any mechanical force by directly screwing onto these optical elements. In particular, the retention frame comprises a first face 601 rotated towards the attachment support and this first face 601 is intended to be positioned against the first face 50 of the attachment support in order to clamp the optical elements.

The assembly of such a light module comprises a first step, during which the optical elements 2, 3, 4 are disposed on the attachment support 5, respectively facing the light source with which they correspond, in order to generate a suitable light beam towards the ray-shaping lens of the module. In a second step, the retention frame 6 is disposed on the attachment support 5 by pressing the first face 601 of the frame against the first face 50 of the support, so as to cover the ends of the optical elements, before being screwed onto the attachment support 5 using attachment means 7 described hereafter. The ends of the optical elements are thus pressed against the attachment support 5 by the retention frame 6, with a pressure force that is evenly distributed between the ends of the optical elements. It can be seen that, in this configuration, the retention frame 6 is disposed around the optical guidance means 20, 30, 40 of the optical elements 2, 3, 4, so that it does not undermine the completion of the optical function, i.e. the guidance of the rays emitted by the sources towards the lens 100 for shaping rays output from the light module 1.

The tabs 21, 31, 41 of the optical elements 2, 3, 4 are arranged in order to be correspondingly housed in the slots 61, 62, 63 formed in the first face 601 of the retention frame 6. These slots comprise a thinner zone formed from the internal periphery 602 of the retention frame 6 by machining the first face 601. The first tabs 21 formed at the lateral ends of the first optical element 2 are intended to be housed in a pair of first slots 61 of the retention frame 6, respectively arranged on opposite edges of the retention frame. Equally, the second tabs 31 of the second optical element 3 are housed in second slots 62 of the retention frame 6 and the third tabs 41 of the third optical element 4 are housed in third slots 63 of the retention frame 6. It will be noted that in the illustrated embodiment, unlike the first and third optical elements 2, 4, the second optical element 3 comprises three second tabs 31, and that the retention frame 6 correspondingly comprises three second slots 62, in this case in order to ensure the optical positioning of the second optical element 3, having a surface projected onto the attachment support 5 that is greater than that of the other optical elements.

It will be noted that the thickness of the tabs 21, 31, 41 of the optical elements is substantially equal to the depth of the slots 61, 62, 63, with the thickness and the depth being measured, when the optical elements and the retention frame are assembled, in a direction perpendicular to the plane in which the attachment support extends. In this way, when the retention frame 6 is assembled on the attachment support 5, the positioning of the tabs in the slots does not hinder the fact that the retention frame 6 and the tabs of the optical elements are pressed against the attachment support 5.

The tabs 21, 31, 41 of the optical elements 2, 3, 4 are configured so that they can be housed in the slots 61, 62, 63 of the retention frame 6, i.e. in a position pressed against the attachment support 5, and to allow the optical guidance parts 20, 30, 40 of these optical elements to be longitudinally released relative to the plane of the attachment support, in order to leave space for the light sources, which are pressed against the attachment support. A longitudinal offset is thus required between the tabs and the optical guidance part of each optical element. To this end, and as is more particularly shown in FIG. 4, the tabs of each optical element 2, 3, 4 are formed by a first portion 21A, 31A, 41A, arranged in the direct extension of the corresponding lateral end of the optical guidance part 20, 30, 40, and by a second portion 21B, 31B, 41B, intended to be housed in one of the corresponding slots 61, 62, 63 of the retention frame 6. The first portion 21A, 31A, 41A extends longitudinally, substantially parallel to the optical axis of the light module and thus perpendicular to the attachment support, so that it is the length of this first portion that determines the clearance of the part for guiding the optical elements relative to the attachment support, in order to leave space for the light sources. Furthermore, the second portion 21B, 31B, 41B perpendicularly extends the first portion 21A, 31A, 41A in order to form a bearing face parallel to the plane mainly defining the attachment support.

When the retention frame 6 is assembled on the attachment support 5 to clamp the optical elements, the ends of the optical elements 2, 3, 4 covered by the retention frame 6 correspond to all or some of the second portions 21B, 31B, 41B of the tabs 21, 31, 41.

Figure 4:
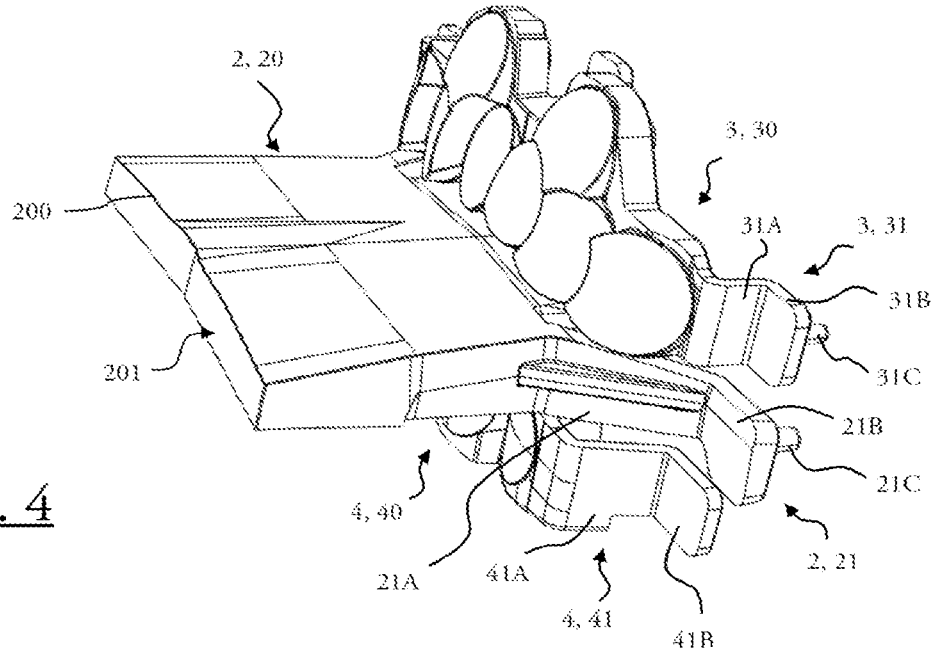
FIG. 4 is a perspective view of the optical elements shown in FIG. 2.

FIGS. 3 and 4 more specifically show this bearing face formed by the face of the second portion 21B, 31B, 41B that is rotated opposite the first portion. This face of the second portion 21B, 31B, 41B comprises indexing pins 21C, 31C, 41C, which are configured to match the shape and dimensions of the openings formed in the attachment support 5. By virtue of this feature, each optical element 2, 3, 4 can be pre-positioned on the attachment support 5 before the retention frame 6 is attached. This thus ensures that each optical element 2, 3, 4 is correctly positioned relative to the attachment support 5 and relative to the light sources previously rigidly connected to the attachment support, particularly by adhesion on a printed circuit board, which is rigidly connected to this attachment support and is not shown herein. It will be understood that this allows, for each optical element 2, 3, 4, the optical guidance means 20, 30, 40 of each optical element to be aligned with a corresponding light source, or with a sub-assembly of light sources.

More specifically, it is to be noted that the indexing pins 21C, 31C, 41C are formed on the second portions of the tabs 21, 31, 41. Thus, during a first assembly step, the optical elements 2, 3, 4 are easily disposed on the attachment support 5, through contact of the second portions of the tabs 21, 31, 41 against this attachment support, before these second portions are covered, in a second assembly step, by the retention frame 6.

In order to complete their optical function, the optical elements 2, 3, 4 can be made of poly(methyl methacrylate) (PMMA) or of any other material allowing light rays to be transmitted towards the shaping lens at the output of the light module. More specifically, at least the means for guiding the optical element should be made of poly(methyl methacrylate) (PMMA), with the tabs being able to be over-moulded on the guidance means in order to be made from another material.

Figure 5:
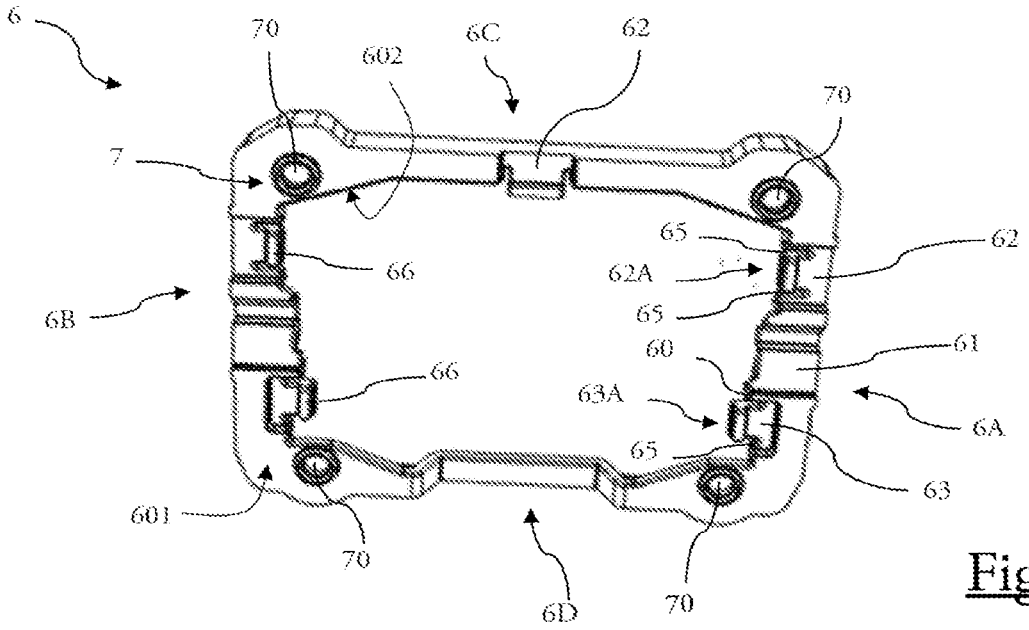
FIGS. 5 and 6 are perspective views, respectively a top view and a bottom view, of the retention frame shown in FIGS. 2 and 3.
Figure 6:
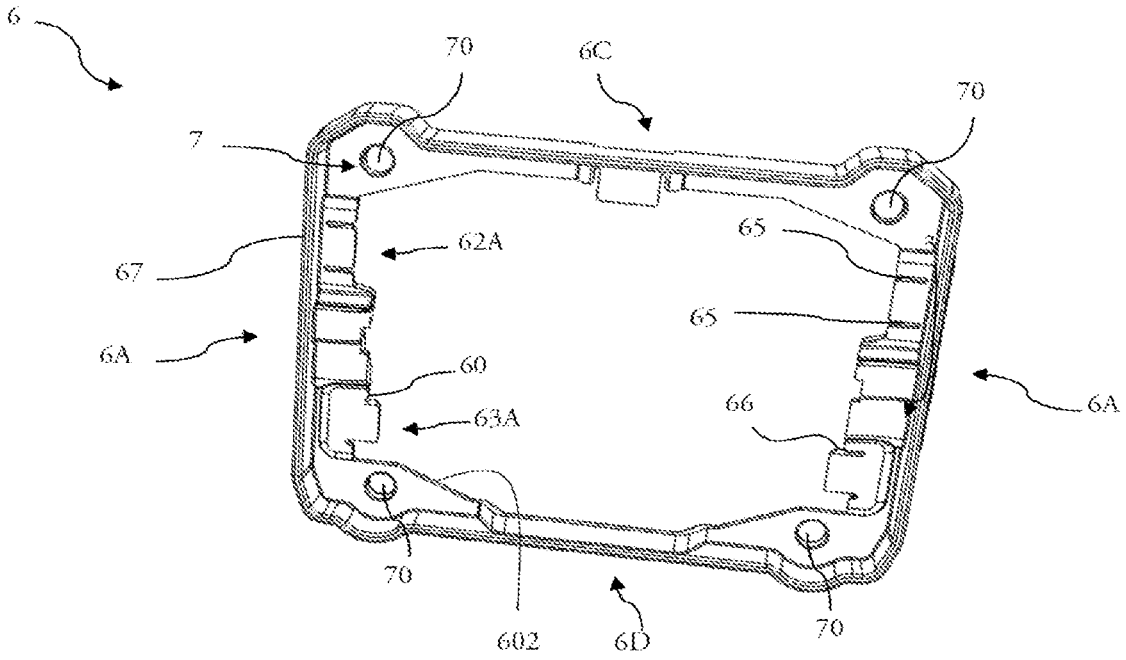

The retention frame 6 will now be described in further detail with reference to FIGS. 5 and 6 in particular.

Means 7 for attaching the retention frame 6 on the attachment support 5 of the light module 1 allow said frame to be attached on the attachment support 5. These means 7 for attaching the retention frame 6 are formed by holes 70 in the retention frame 6 facing bores formed in the attachment support 5. It will be noted that these attachment means 7 are formed on sections of the retention frame 6 different from the sections comprising the slots 61, 62, 63 and allow the ends of the optical elements to be clamped against the attachment support. The holes 70 of the retention frame 6, and the associated bores thereof, are provided in order to each receive an attachment screw 71, shown in FIG. 2. When the light module 1 is in the assembled state, the attachment screws 71 press the retention frame 6 against the attachment support 5. The optical elements 2, 3, 4 are then also pressed and held by their tabs 21, 31, 41 against the attachment support 5 via the retention frame 6.

More specifically, the retention frame 6 is of rectangular shape and it is formed by four branches 6A, 6B, 6C, 6D. Two first branches 6A, 6B facing one another comprise the slots 61, 62, 63 and two second branches 6C, 6D of the retention frame 6 each comprise at least one attachment means 7, namely two attachment means 7 in this case. It will then be understood that the first branches 6A, 6B allow the optical elements 2, 3, 4 to be held against the attachment support 5, whereas the second branches 6C, 6D allow the retention frame 6 to be attached on the attachment support 5. However, it will be noted that a second slot 62 can be provided on one of the second branches 6C, 6D in order to stabilize the optical position of the second optical element 3.

The retention frame 6 comprises at least one positioning finger to help keep at least one optical element in place and, more specifically, to help keep one end of an optical element in place in its corresponding slot. In the example shown in FIG. 5 in particular, the frame comprises a plurality of these positioning fingers 62A, 63A, which are respectively formed in the vicinity of one of the slots and, more specifically in this case, in the vicinity of the second and third slots 62, 63 of the retention frame 6. More specifically, the retention frame comprises a pair of positioning fingers 62A respectively arranged in the vicinity of each of the second slots 62.

Each positioning finger has a base 64 configured as a flexible strip, at the end of which a pad 66 is formed in order to come into abutment against the second portions of the tabs of the optical elements to be retained, in this case the second and third tabs 31, 41.

The base 64 of each finger is defined in the wall of the retention frame, in the zone of the corresponding slot, by two cuts 65, which provide the strip formed in the base with flexibility. The pad 66 of each finger forms an element projecting from the base, at the free end thereof, which extends on the side of the first face 601 of the retention frame. In this way, when positioning the retention frame against the attachment support, the pads 66 come into abutment against the second portions of the tabs pre-positioned on the attachment support before the first face of the retention frame is in contact with the attachment support. The flexibility of the base 64 supporting the pad 66 advantageously allows a gap to be filled that can exist between the tab and the corresponding slot, for example, when the thickness of the tab is lower than the depth of the corresponding slot. It will be noted that the base of the positioning fingers 63A corresponding to the third slots 63 extends beyond the inner edge 602 of the retention frame 6, in order to ensure contact far enough away from the free end of the tabs of the optical element to be held in position. It is understood that the positioning fingers help to retain the optical elements without mechanically stressing them.

A stiffening rib 67 is provided on the retention frame 6 in order to enhance its mechanical strength. As shown, the stiffening rib 67 defines an outer profile 68 of the retention frame 6. It is to be noted that the attachment support 5 on which the retention frame 6 is disposed is a support for thermally dissipating calories released by the light sources.

Of course, the features and variations of the invention can be associated with one another, according to various combinations, insofar as they are not incompatible or mutually exclusive. In particular, variations of the invention can be contemplated comprising only a selection of features subsequently described in isolation from the other described features, if this selection of features is sufficient for providing a technical advantage or for differentiating the invention from the prior art.

The invention claimed is:

1. A light module for a motor vehicle headlight, comprising:

at least two light sources;

two optical elements, respectively configured for guiding light rays emitted by a light source;

an attachment support, which the optical elements and the light sources are retained against; and the optical elements comprising at least one first optical element associated with a first light source and one second optical element associated with a second light source, wherein the light module comprises a frame that retains the optical elements on the attachment support.

2. The light module according to claim 1, wherein the retention frame comprises at least one means for attaching on the attachment support of the light module.

3. The light module according to a claim 1, wherein a third optical element is associated with a third light source, the retention frame being configured to hold the three optical elements in position.

4. The light module according to claim 1, wherein each optical element is configured to emit a light beam towards a shaping lens arranged at the output of the light module.

5. A motor vehicle headlight comprising at least one light module according to claim 1.

6. A Light module for a motor vehicle headlight, comprising:

at least two light sources;

two optical elements, respectively configured for guiding light rays emitted by a light source;

an attachment support, against which the optical elements and the light sources are disposed; and the optical elements comprising at least one first optical element associated with a first light source and one second optical element associated with a second light source, wherein the light module comprises a frame for retaining the optical elements on the attachment support, wherein a third optical element is associated with a third light source, the retention frame being configured to hold the three optical elements in position, and wherein the first optical element is disposed between the second optical element and the third optical element, so that the firm optical element is configured to participate in the formation of a beam complementary to the beam formed by the second optical element, said third optical element being configured to allow an additional beam to be formed for over-intensifying the overall beam formed by the complementarity of said beam and said additional beam.

7. A light module for a motor vehicle headlight, comprising:

at least two light sources;

two optical elements, respectively configured for guiding light rays emitted by a light source;

an attachment support, against which the optical elements and the light sources are disposed; and the optical elements comprising at least one first optical element associated with a first light source and one second optical element associated with a second light source, wherein the light module comprises a frame for retaining the optical elements on the attachment support, and wherein each of the optical elements has a central optical portion, forming an optical guidance means, and lateral tabs, transversely arranged on either side of the central optical portion.

8. The light module according to a claim 7, wherein at least one positioning finger is formed in the retention frame, in the zone of a slot of the retention frame, and is configured to come into abutment against a tab of at least one optical element.

9. The light module according to claim 8, wherein the finger comprises a resilient base, formed in the plane of the retention frame and delimited by two cuts in the zone of the slot, and a pad forming a projection from the base in order to come into abutment on the tab.

10. The light module according to claim 7, wherein the tabs of each optical element are formed by a first portion, arranged in the direct extension of the corresponding lateral end of the optical guidance part, and by a second portion intended to be clamped between the retention frame and the attachment support.

11. The light module according to claim 10, wherein the indexing pins are formed on the two portions of the tabs.

12. The light module according to claim 7, wherein the tabs of each optical element each support indexing pins configured to engage with openings formed in the attachment support.

13. The light module according to claim 12, wherein the indexing pins are formed on the two portions of the tabs.

14. The light module according to claim 7, wherein the retention frame is configured to at least partly cover the tabs of each of the optical elements.

15. The light module according to claim 14, wherein the tabs of each optical element are formed by a first portion, arranged in the direct extension of the corresponding lateral end of the optical guidance part, and by a second portion intended to be clamped between the retention frame and the attachment support.

16. The light module according to claim 14, wherein the tabs of each optical element each support indexing pins configured to engage with openings formed in the attachment support.

17. The light module according to claim 14, wherein the tabs of each optical element are arranged in order to be at least partly housed in slots formed in the retention frame, respectively.

18. The light module according to a claim 14, wherein at least one positioning finger is formed in the retention frame, in the zone of a slot of the retention frame, and is configured to come into abutment against a tab of at least one optical element.

19. The light module according to claim 7, wherein the retention frame comprises at least one means for attaching on the attachment support of the light module.

20. The light module according to a claim 7, wherein a third optical element is associated with a third light source, the retention frame being configured to hold the three optical elements in position.

* * * * *